US010204721B2

(12) United States Patent
Kim et al.

(10) Patent No.: US 10,204,721 B2
(45) Date of Patent: Feb. 12, 2019

(54) RESISTOR ELEMENT AND METHOD OF MANUFACTURING THE SAME

(71) Applicant: SAMSUNG ELECTRO-MECHANICS CO., LTD., Suwon-Si, Gyeonggi-Do (KR)

(72) Inventors: Young Key Kim, Suwon-Si (KR); Jea Hoon Lee, Suwon-Si (KR); Jung Min Nam, Suwon-Si (KR); Hae In Kim, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 53 days.

(21) Appl. No.: 14/938,716

(22) Filed: Nov. 11, 2015

(65) Prior Publication Data

US 2016/0172083 A1 Jun. 16, 2016

(30) Foreign Application Priority Data

Dec. 15, 2014 (KR) ..... 10-2014-0180323

(51) Int. Cl.

| | |
|---|---|
| ***H01C 1/142*** | (2006.01) |
| ***H01C 1/012*** | (2006.01) |
| ***H01C 7/00*** | (2006.01) |
| ***H01C 17/28*** | (2006.01) |
| *H01C 17/06* | (2006.01) |

(52) U.S. Cl.

CPC ..... *H01C 1/142* (2013.01); *H01C 1/012* (2013.01); *H01C 7/003* (2013.01); *H01C 17/283* (2013.01); *H01C 17/06* (2013.01)

(58) Field of Classification Search

CPC ..... H01C 1/142; H01C 17/06; H01C 17/28
USPC ..... 338/307
See application file for complete search history.

(56) References Cited

U.S. PATENT DOCUMENTS 3,996,551 A 12/1976 Croson
5,170,146 A * 12/1992 Gardner ..... H01C 17/006 338/272

(Continued)

FOREIGN PATENT DOCUMENTS

JP 2011-009288 A 1/2011
JP 2011-238730 A 11/2011

(Continued)

OTHER PUBLICATIONS

Notice of Office Action issued in Korean Patent Application No. 10-2014-0180323, dated Nov. 28, 2018 (English translation).

*Primary Examiner* — Kyung Lee
*Assistant Examiner* — Iman Malakooti
(74) *Attorney, Agent, or Firm* — McDermott Will & Emery LLP

(57) ABSTRACT

A resistor element includes a base substrate, a resistor layer disposed on one surface of the base substrate, a first electrode layer and a second electrode layer disposed on the resistor layer to be spaced apart from each other, a third electrode layer disposed between the first electrode layer and the second electrode layer to be spaced apart from the first electrode layer and the second electrode layer, a conductive resin electrode disposed on at least one end of the third electrode layer, and first to third plating layers disposed on the first to third electrode layers, respectively.

13 Claims, 10 Drawing Sheets

(56) References Cited

U.S. PATENT DOCUMENTS

| | | | | |
|---|---|---|---|---|
| 5,339,065 | A * | 8/1994 | Slenker | H03H 7/25 333/81 A |
| 5,790,385 | A | 8/1998 | Tanimura | |
| 5,917,403 | A * | 6/1999 | Hashimoto | H01C 17/065 252/514 |
| 2013/0154790 | A1 | 6/2013 | Park et al. | |

FOREIGN PATENT DOCUMENTS

| | | |
|---|---|---|
| KR | 10-0386644 | 4/1997 |
| KR | 2008-235523 | 10/2008 |
| KR | 2013-0070682 A | 6/2013 |

* cited by examiner

RESISTOR ELEMENT AND METHOD OF MANUFACTURING THE SAME

CROSS-REFERENCE TO RELATED APPLICATION

This application claims the benefit of priority to Korean Patent Application No. 10-2014-0180323 filed on Dec. 15, 2014, with the Korean Intellectual Property Office, the disclosure of which is incorporated herein by reference.

BACKGROUND

The present disclosure relates to a resistor element, a method of manufacturing the same, and a board having the same.

A chip-type resistor element is suitable for implementing a precise degree of resistance, and serves to control a current and drop a level of a voltage in a circuit.

In circuits designed to use resistors, when the resistors are damaged by external impacts, such as power surges, static electricity discharges, and the like, that cause defects such as short-circuits, all currents in a power supply flow in integrated circuits (ICs), which leads to a secondary damage to the circuits.

In order to prevent the above-described problem, including a plurality of resistors in circuits at the time of designing the circuits may be considered. However, the above-described circuit design has a problem in that a size of a substrate is inevitably increased.

In particular, in the case of mobile devices which have been gradually miniaturized, since the above-described increase in the size of the substrate for stable circuits is not preferable, research into a resistor element capable of more effectively controlling currents flowing in the circuits is required.

SUMMARY

An aspect of the present disclosure may provide a resistor element, a method of manufacturing the same, and a board having the same.

According to an aspect of the present disclosure, a resistor element may include a first electrode layer and a second electrode layer disposed on a resistor layer, a third electrode layer disposed between the first electrode layer and the second electrode layer, and a conductive resin electrode disposed on at least one end of the third electrode layer, wherein a length of a third terminal may be increased by the conductive resin electrode to improve length deviations in first to third terminals.

According to another aspect of the present disclosure, a method of manufacturing a resistor element may include forming a resistor layer on a base substrate, forming first to third electrode layers on the resistor layer, controlling a resistance value of the resistor layer, and forming a conductive resin electrode on at least one end of the third electrode layer, wherein the third electrode layer having a width narrower than that of the base substrate so as to control the resistance value is reinforced with the conductive resin electrode to reduce length deviations in terminals.

According to another aspect of the present disclosure, a board having a resistor element mounted thereon may include a resistor element and a circuit board having the resistor element mounted thereon, wherein the resistor element is the same as described above, and has improved connectivity with electrode pads disposed on the circuit board and terminals at the time of mounting the resistor element on the board.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
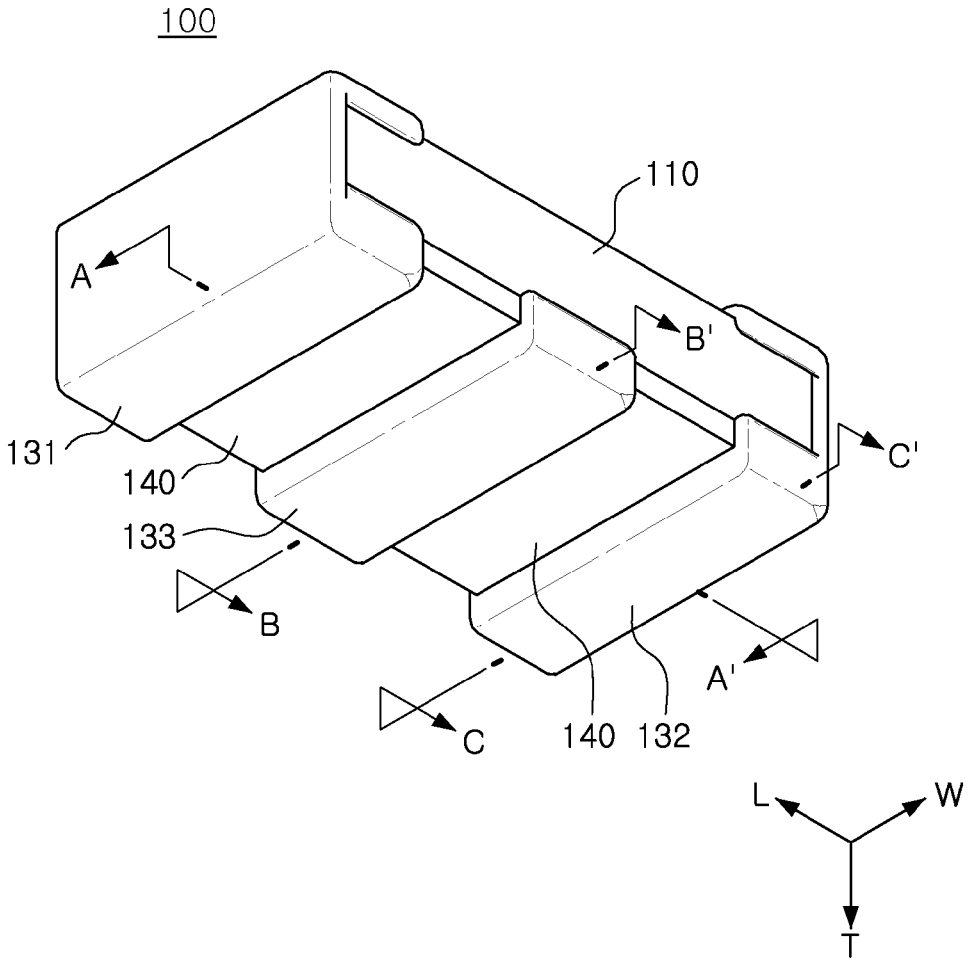
FIG. 1 is a perspective view of a resistor element according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

In the accompanying drawings, W, T, L directions indicate a width direction, a thickness direction, and a length direction of a base substrate, respectively.

Figure 2:
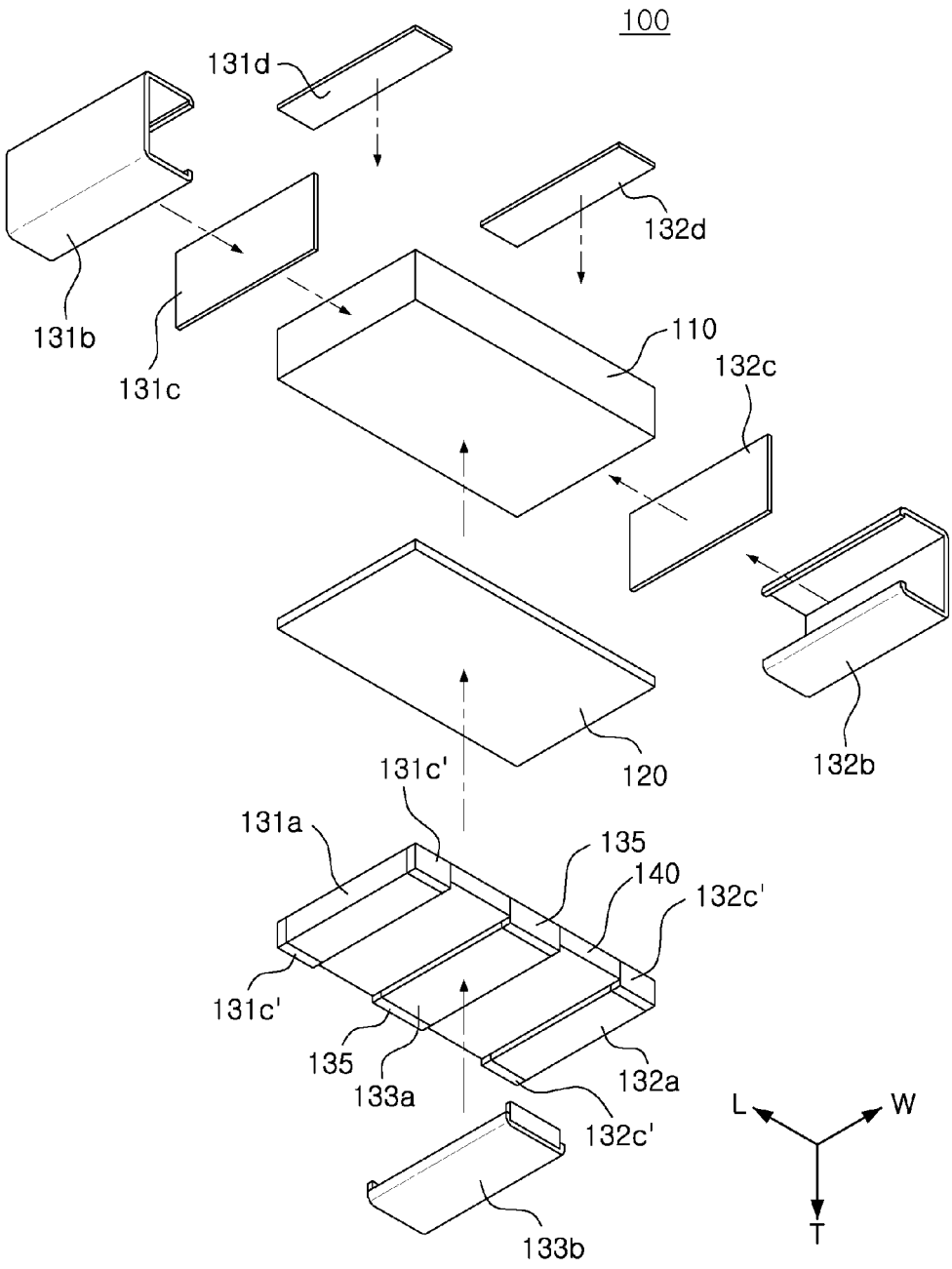
FIG. 2 is an exploded perspective view of the resistor element according to the exemplary embodiment in the present disclosure.

FIG. 1 is a perspective view of a resistor element 100 according to an exemplary embodiment in the present disclosure, and FIG. 2 is an exploded perspective view of FIG. 1.

Figure 3:
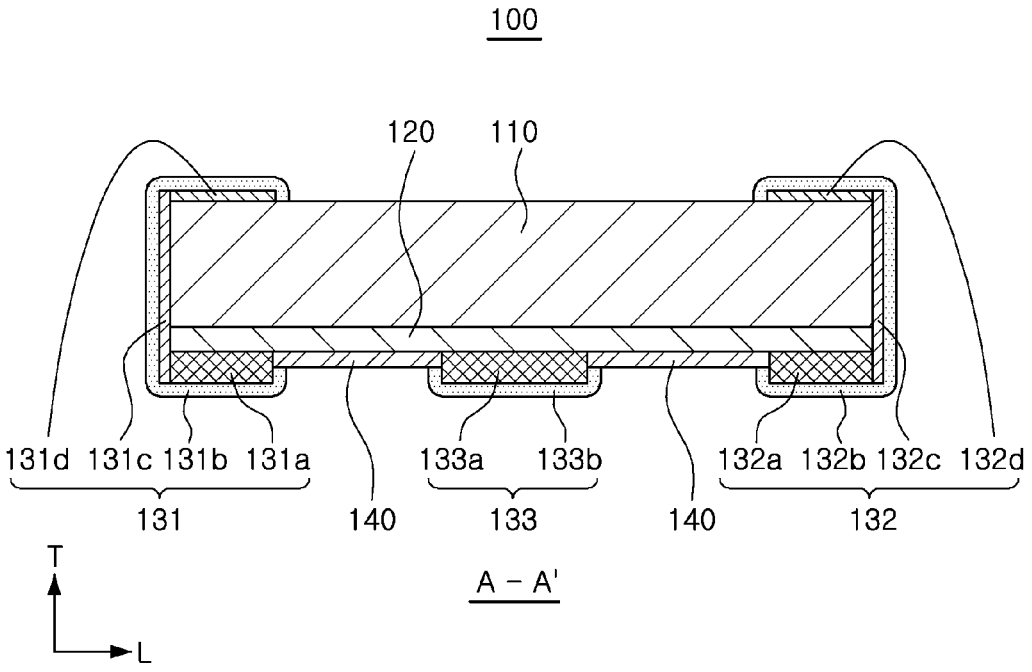
FIG. 3 is a cross-sectional view taken along line A-A' of FIG. 1.

FIG. 3 is a cross-sectional view taken along line A-A' of FIG. 1.

Referring to FIGS. 1 to 3, the resistor element 100 according to an exemplary embodiment in the present disclosure may include a base substrate 110, a resistor layer 120, and first to third terminals 131, 132, and 133 disposed on the resistor layer.

The base substrate 110 may be provided to support the resistor layer 120 and secure strength of the resistor element 100. For example, the base substrate 110 may be provided as an aluminum substrate, an insulating substrate, or the like, but is not specifically limited thereto.

The base substrate 110 may have a rectangular parallelepiped thin plate shape, and may be formed of an alumina material insulated by anodizing a surface of the base substrate, but the shape and the material of the base substrate 110 are not limited thereto.

In addition, the base substrate 110 may be formed of a material having excellent thermal conductivity so as to serve as a thermal diffusion path through which heat generated from the resistor layer 120 externally radiates when the base substrate 110 is used for the resistor element.

The resistor layer 120 may be disposed on one surface of the base substrate 110, and may include a first resistor part connected to a first electrode and a second electrode to form resistance, and a second resistor part connected to the second electrode and a third electrode to form resistance, wherein the first resistor part and the second resistor part may be formed as an integrated resistor layer as illustrated in FIG. 2.

The resistor layer 120 may include Ag, Pd, Cu, Ni, a Cu—Ni-based alloy, an Ni—Cr-based alloy, an Ru oxide, an Si oxide, Mn and Mn-based alloys, or the like, as a main component, and may include various materials depending on required resistance values, but the material of the resistor layer 120 is not limited thereto.

According to an exemplary embodiment in the present disclosure, one integrated resistor layer 120 may include the first resistor part and the second resistor part to improve a space efficiency as compared to a case in which the first resistor part and the second resistor part are separately formed.

The first resistor part may be formed between the first terminal 131 and the third terminal 133, and the second resistor part may be formed between the second terminal 132 and the third terminal 133 to thereby control currents flowing in circuits. The first resistor part and the second resistor part may use the third terminal 133 as a common terminal.

The circuits formed on the substrate may use resistors to control the currents, wherein in order to prevent the circuits from being damaged when resistors are damaged by external impacts such as surge, static electricity, and the like, two or more resistor elements may be used or an array resistor in which respective resistor parts are connected to a pair of independent terminals may be used. Meanwhile, when two or more resistor elements are used or the existing array resistor is used, a relatively larger mounting space may be required.

According to an exemplary embodiment in the present disclosure, one resistor element 100 includes the three terminals 131, 132, and 133, and the two resistor parts each disposed between two terminals, such that the space of the substrate in which the resistor element is disposed may be reduced to improve a space efficiency, and a device including the resistor element may be miniaturized and precised, as compared to a case in which two resistor elements each including one resistor part are used or a case in which an array resistor in which respective resistor parts are connected to a pair of independent terminals is used.

That is, three-terminal typed resistor element 100 including two resistor parts, one common terminal 133, and two terminals 131 and 132 of each of the first and second resistor parts may be implemented, resulting in substantially decreasing one terminal. Accordingly, a relatively smaller resistor element 100 may be achieved through a method similar to the existing method.

Any one of the first resistor part and the second resistor part may be trimmed according to a resistance value thereof to determine a resistance value of the remaining resistor part.

The trimming process refers to a cutting process for finely controlling resistance values, and the like, and may determine the resistance value set in each resistor part at the time of designing circuits.

According to an exemplary embodiment in the present disclosure, errors in resistance values may be reduced as compared to a case of using two single resistors or an array resistor.

In addition, the resistor element 100 according to an exemplary embodiment in the present disclosure may be manufactured by first forming the resistor layer 120 on one surface of the base substrate 110, forming the first to third electrode layers 131*a*, 132*a*, and 133*a* on the resistor layer 120, to form the first to third terminals 131, 132, and 133. Accordingly, an area of the resistor layer may be expanded as compared to a case in which a resistor element manufactured by first forming electrode layers on a base substrate and then forming a resistor layer to overlap with the electrode layers.

According to an exemplary embodiment in the present disclosure, power of the resistor element 100 may be increased by the expansion of the area of the resistor layer 120. In addition, the electrode layers 131*a*, 132*a*, and 133*a* may be disposed on the resistor layer 120, such that respective overlapped areas between the resistor layer 120 and the first to third electrode layers 131*a*, 132*a*, and 133*a* may be uniform to improve resistance value variations (non-uniformity).

The first to third terminals 131, 132, and 133 may include the first to third electrode layers 131*a*, 132*a*, and 133*a* disposed on the resistor layer 120, respectively, and may include first to third plating layers 131*b*, 132*b* and 133*b* disposed on the first to third electrode layers 131*a*, 132*a*, and 133*a*, respectively.

For example, as illustrated in FIG. 2, the first terminal 131 may include the first electrode layer 131*a* and the first plating layer 131*b*, the second terminal 132 may include the second electrode layer 132*a* and the second plating layer 132*b*, and the third terminal 133 may include the third electrode layer 133*a* and the third plating layer 133*b*.

The first to third electrode layers 131*a*, 132*a*, and 133*a* may be disposed on one surface of the resistor layer 120 to be spaced apart from each other, and the third electrode layer 133*a* may be disposed between the first electrode layer 131*a* and the second electrode layer 132*a*.

The first to third electrode layers 131*a*, 132*a*, and 133*a* may be formed by coating the resistor layer 120 with a conductive paste for forming conductive electrodes, wherein the conductive paste may be coated using a screen printing process, or the like, but the forming method of the electrode layers is not limited thereto.

The first to third electrode layers 131*a*, 132*a*, and 133*a* may be formed of materials different from those of the above-described resistor element. For example, the materials of the electrode layers may be copper, nickel, platinum, or the like, or may be the same component as the resistor element if needed.

According to an exemplary embodiment in the present disclosure, the third terminal disposed between the first and second terminals may include a conductive resin electrode 135 disposed on at least one end of the third electrode layer.

The conductive resin electrode 135 may be disposed on both ends of the third electrode layer 133*a*.

In the manufacturing of the resistor element, a plurality of resistor layers and the first to third electrode layers may be formed on the base substrate capable of forming the plurality of resistor elements, resistance values of the resistor layers may be controlled by the trimming process, and the manufactured resistor elements may be cut into individual chip size. In this case, the third electrode layer may not entirely cover the base substrate in a width direction but may be formed to expose a portion of the base substrate in the width direction in order to measure the resistance values for controlling the resistance values before the resistor element is cut into individual chip size.

In a case in which the third electrode layer entirely covers the base substrate in a width direction, the third electrode layers of the adjacent resistor elements may be connected to each other before the resistor element is cut into individual chip size, such that it may be difficult to measure resistance values.

When the first and second electrode layers 131*a* and 132*a* have the same width as a width of the base substrate, a problem may not occur. However, when the third electrode layer 133*a* has the same width as the width of the base substrate, a problem may arise during a trimming process performed to control resistance values in manufacturing the resistor element. A detailed description thereof will be provided hereinafter.

In addition, even though the first and second electrode layers 131*a* and 132*a* have a length smaller than that of the base substrate, at the time of forming side surface electrodes 131*c* and 132*c*, both ends of the first and second electrode layers may be reinforced with side surface electrode materials such that portions of the base substrate adjacent to the both ends of the first and second electrode layers may be covered in a length direction, but both ends of the third electrode layer 133*a* may be difficult to reinforce, even though the side surface electrodes are formed.

As described above, when the plating layers are formed in a state in which both ends of the third electrode layer 133*a* are not reinforced, the base substrate 110 may be exposed to both ends of the third terminal, and the third terminal may by formed to have a width shorter than widths of the first and second terminals.

When a portion of the base substrate is exposed due to the third terminal having a width shorter than widths of the first and second terminals, an exposed part of the base substrate may cause error in recognizing image for mounting the resistor element on a surface of a circuit board.

In addition, when the third terminal has a width shorter than widths of the first and second terminals, and when an excessive amount of solder is disposed on the third terminal due to non-uniform mounting areas of the first to third terminals, arrangement of the resistor element may be distorted due to agglomeration of the electrodes and the solder.

Figure 4:
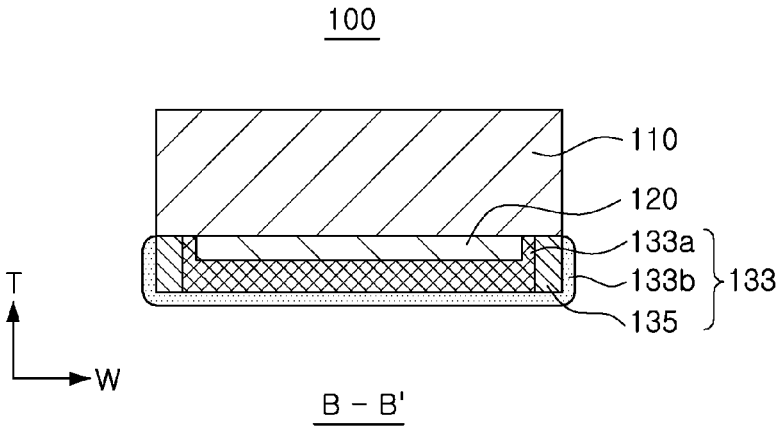
FIG. 4 is a cross-sectional view taken along line B-B' of FIG. 1.

However, as illustrated in FIG. 4, a cross-sectional view taken along line B-B' of FIG. 1, the conductive resin electrodes 135 may be disposed on both ends of the third electrode layer 133*a* to increase the width of the third terminal 133, such that a non-uniformly exposed area of the base substrate 110 may be removed to reduce errors in recognizing images at the time of mounting the resistor element on a substrate.

Further, when the excessive amount of solder is disposed on the third terminal 133, an escape space for the solder may be formed, such that deformation of a position of the resistor element at the time of mounting the resistor element on the substrate may be reduced.

In addition, a surface area of the third terminal 133 may be expanded to increase a heat radiation effect, thereby improving power properties of the resistor element, and fixation strength and warpage strength may be improved in a state in which the resistor element is mounted on the substrate.

According to an exemplary embodiment in the present disclosure, first and second rear surface electrodes 131*d* and 132*d* may be selectively disposed on the other surface of the base substrate to face the first and second electrode layers 131*a* and 132*a*. When the first and second rear surface electrodes 131*d* and 132*d* are disposed on the other surface of the base substrate 110, the first and second electrode layers 131*a* and 132*a* and the first and second rear surface electrodes 131*d* and 132*d* may offset power of the resistor element 100 having an effect on the base substrate during a sintering process, to prevent the base substrate from being bent by the resistor element.

The first and second rear surface electrodes 131*d* and 132*d* may be formed by printing a conductive paste, but the forming method of the rear surface electrodes is not limited thereto.

According to an exemplary embodiment in the present disclosure, both end surfaces of a laminate formed of the base substrate 110, the resistor layer 120, and the first to third electrode layers 131*a*, 132*a*, and 133*a* may be provided with a pair of side surface electrodes 131*c* and 132*c* connected to the first and second electrode layers, respectively.

The laminate may selectively include the above-described first and second rear surface electrodes 131*d* and 132*d*.

When the laminate includes the first and second rear surface electrodes 131*d* and 132*d*, the pair of side surface electrodes 131*c* and 132*c* may be disposed so that the first electrode layer 131*a* and the second electrode layer 132*a* are connected to the first rear surface electrode 131*d* and the second rear surface electrode 132*d*, respectively.

The pair of side surface electrodes 131*c* and 132*c* may be formed on end surfaces of the laminate by sputtering conductive materials forming the side surface electrodes 131*c* and 132*c*.

Figure 5:
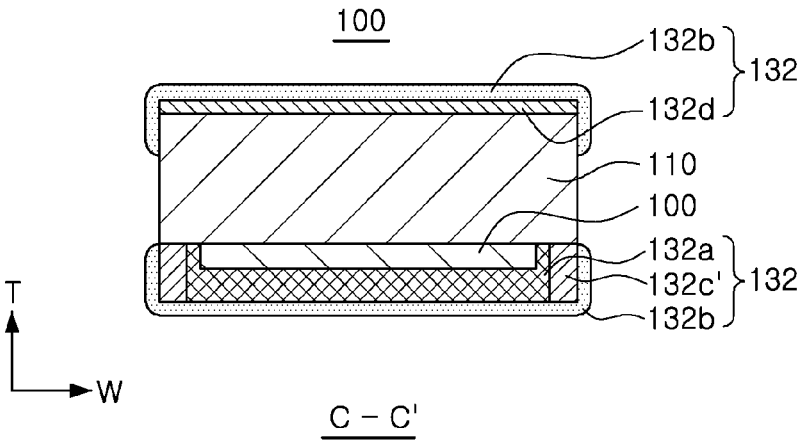
FIG. 5 is a cross-sectional view taken along line C-C' of FIG. 1.

As illustrated in FIG. 5, a cross-sectional view taken along line C-C' of FIG. 1, when the second electrode layer 132*a* has a width smaller than a width of the base substrate 110, both ends of the second electrode layer may be reinforced to form extension parts 132*c*' of the second electrode layer.

The first terminal 131 may have the same internal structure as an internal structure of the second terminal 132 illustrated in FIG. 5.

According to an exemplary embodiment in the present disclosure, a protective layer 140 provided to protect the resistor layer from external impacts may be disposed on portions of a surface of the resistor layer without the first to third electrode layers 131*a*, 132*a*, and 133*a* disposed thereon.

The protective layer 140 may be formed of silicon ($SiO_2$) or a glass material, and may be formed on the resistor layer 120 using an overcoating process, but the material and the formation of the protective layer are not limited thereto.

When the electrode layers 131*a*, 132*a* and 133*a* are disposed on the resistor layer 120 according to an exemplary embodiment in the present disclosure, even though the protective layer 140 is disposed on the resistor layer 120, the first to third terminals 131, 132, and 133 protrude further than the protective layer 140. Accordingly, at the time of mounting the resistor element on the substrate, the terminals 131, 132, and 133 may easily contact electrode pads disposed on the substrate.

According to an exemplary embodiment in the present disclosure, the protective layer 140 may be formed and then in order to mount the resistor element on the substrate, first to third plating layers 131*b*, 132*b*, and 133*b* may be formed on the first to third electrode layers 131*a*, 132*a*, and 133*a*, respectively.

The third plating layer 133*b* may cover the conductive resin electrodes 135 disposed on both ends of the third electrode layer 133*a*.

When the resistor element 100 according to an exemplary embodiment in the present disclosure includes the rear surface electrodes 131*d* and 132*d* and the side surface electrodes 131*c* and 132*c*, the plating layers 131*b* and 132*b* may even be formed on the rear surface electrodes 131*d* and 132*d* and the side surface electrodes 131*c* and 132*c*.

For example, the first plating layer 131*b* may cover the first electrode layer 131*a*, the first rear surface electrode 131*d*, and the side surface electrode 131*c* connecting the first electrode layer 131*a* and the first rear surface electrode 131*d*, and the second plating layer 132*b* may cover the second electrode layer 132*a*, the second rear surface electrode 132*d*, and the side surface electrode 132*c* connecting the second electrode layer 132*a* and the second rear surface electrode 132*d*.

In addition, when the extension parts 131*c*' and 132*c*' of the first and second electrode layers are formed on both ends of the first and second electrode layers, the first and second plating layers may cover the extension parts 131*c*' and 132*c*' of the first and second electrode layers.

According to an exemplary embodiment in the present disclosure, in order to compensate a thickness of the third plating layer 133*b* having a reduced thickness due to a low electricity conduction amount at the time of forming the plaiting layers, the third electrode layer 133*a* may have a thick thickness or may be formed in a multilayer, such that at the time of mounting the resistor element on the substrate, connection of three terminals may be stably achieved.

In addition, after mounting the resistor element on the substrate, the third terminal 133 may stably contact the solder to increase fixation strength of the resistor element 100, and surface area of the third terminal 133 may be expanded to increase a heat radiation effect, thereby improving power properties of the resistor element 100.

Method of Manufacturing Resistor Element

Figure 6:
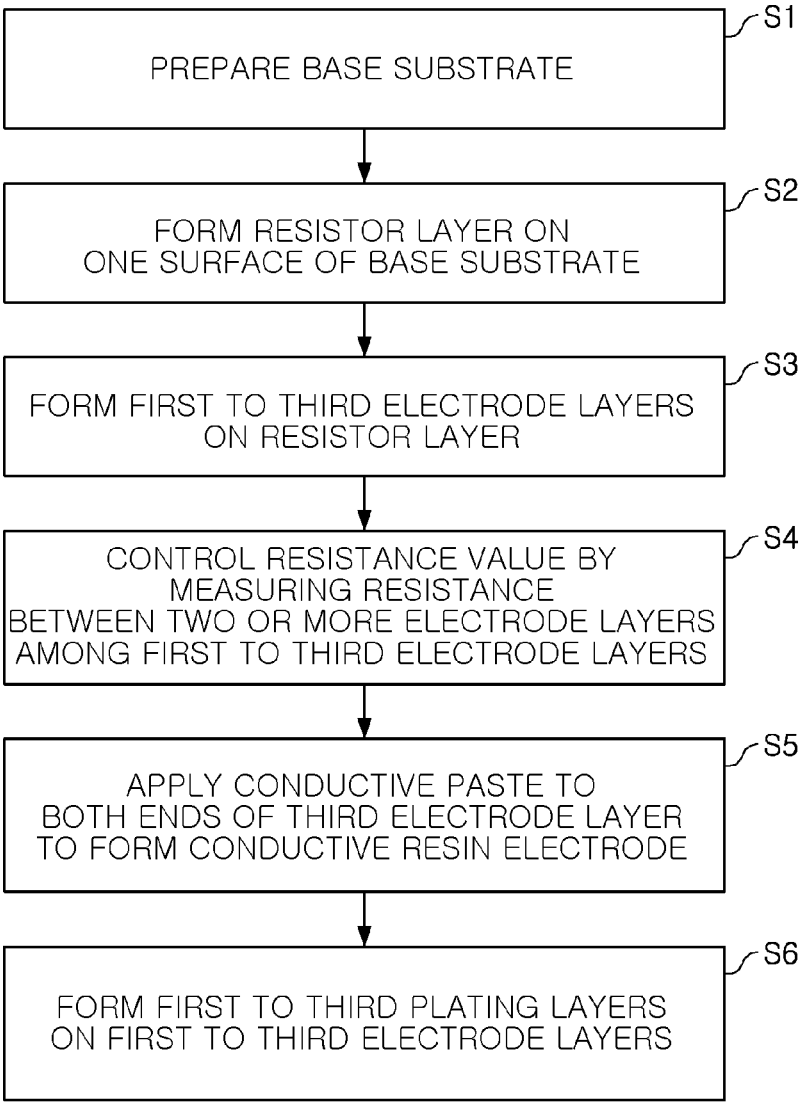
FIG. 6 is a flow chart illustrating a method of manufacturing a resistor element according to another exemplary embodiment in the present disclosure.

FIG. 6 is a flow chart illustrating a method of manufacturing a resistor element according to the present exemplary embodiment in the present disclosure, and FIGS. 7A through 7G are plan views sequentially illustrating a method of manufacturing the resistor element according to another exemplary embodiment in the present disclosure.

Referring to FIG. 6, the method of manufacturing the resistor element according to an exemplary embodiment in the present disclosure may include preparing a base substrate S1; forming a resistor layer on one surface of the base substrate S2; forming first to third electrode layers on the resistor layer S3; controlling a resistance value S4; forming conductive resin electrodes on both ends of the third electrode layer S5; and forming plating layers S6.

In the manufacturing method according to another exemplary embodiment in the present disclosure, descriptions of the same characteristics as characteristics of the above-described resistor element according to the exemplary embodiment in the present disclosure will be omitted.

Figure 7A:
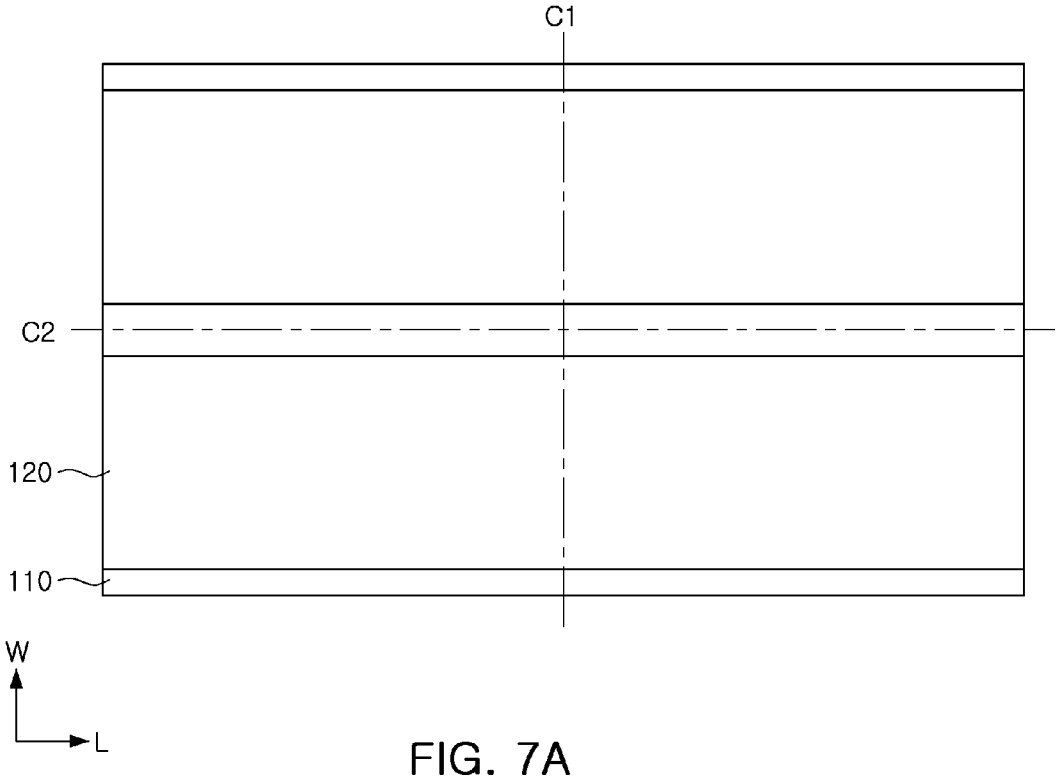
FIGS. 7A through 7G are plan views sequentially illustrating a method of manufacturing the resistor element according to another exemplary embodiment in the present disclosure.
Figure 7B:
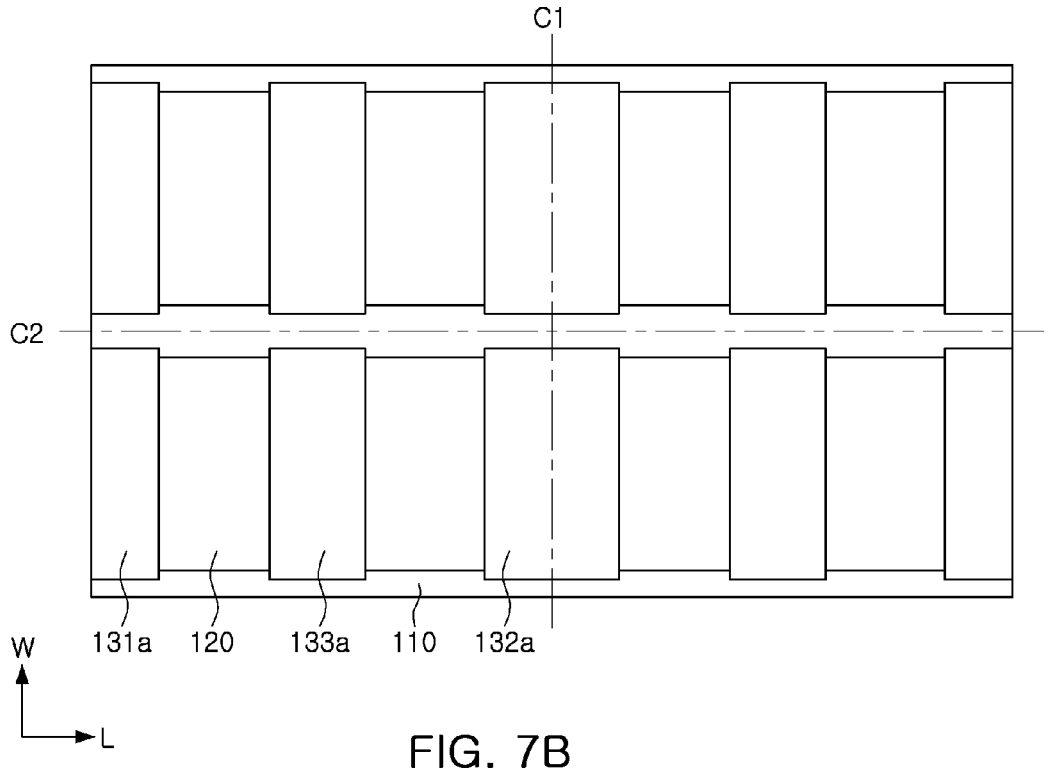

First, as illustrated in FIG. 7A, after the base substrate 110 on which the resistor layer and the electrode layers will be disposed may be prepared S1, the resistor layer 120 may be formed on one surface of the base substrate 110 S2, wherein the resistor layer 120 may be formed by printing a resistor paste.

As illustrated in FIG. 7A, the base substrate 110 may have a size capable of forming the plurality of resistor elements, and then may be cut along cutting lines C1 and C2 to be formed as individual resistor elements.

The resistor layer 120 may be continuously disposed in a length direction of the base substrate 110, and may be spaced apart from each other in a width direction of the base substrate 110 to be printed to have a stripe shape.

Next, as illustrated in 7B, the first to third electrode layers 131*a*, 132*a*, and 133*a* may be formed on the resistor layer 120 S3. The first and second electrode layers may be continuously formed in the plurality of resistor elements in the width direction of the base substrate. However, a case in which the first and second electrode layers are spaced apart from each other in the width direction of the base substrate is described below as an example.

The second electrode layer 132*a* may be integrated with the first electrode layer 131*a* of the adjacent individual resistor element on the basis of the cutting line C1, and when cutting the resistor elements along the cutting line C1, the first electrode layer and the second electrode layer of respective resistor elements may be separated from each other.

The third electrode layer 133*a* may be spaced apart from the third electrode layer of the adjacent individual resistor element on the basis of the cutting line C2. In a case in which the plurality of third electrode layers are not spaced apart from each other, it may be difficult to measure the resistance value of each resistor part.

Figure 7C:
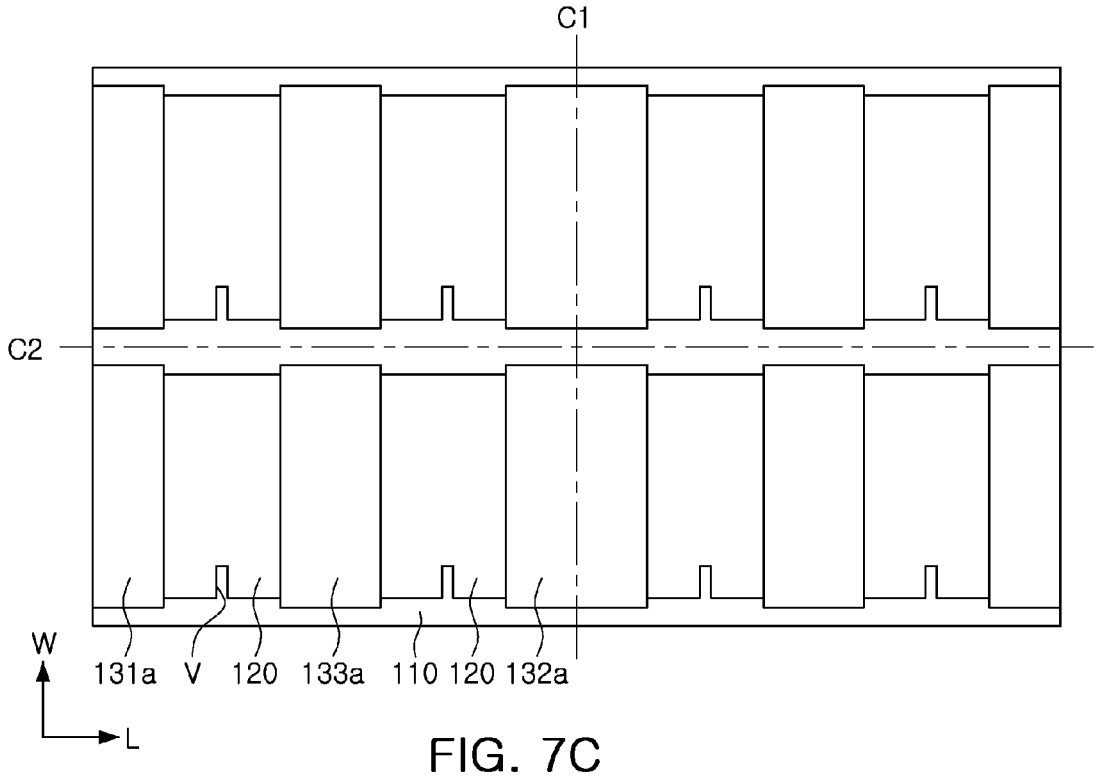

Next, as illustrated in FIG. 7C, resistance values of the first resistor part between the first electrode layer and the third electrode layer, and the second resistor part between the second electrode layer and the third electrode layer may be measured on the basis of the individual resistor element formed after the cutting, and a trimming process performed to control the resistance values may be performed S4.

In the trimming process, a groove V may be formed in the resistor layer 120.

Figure 7D:
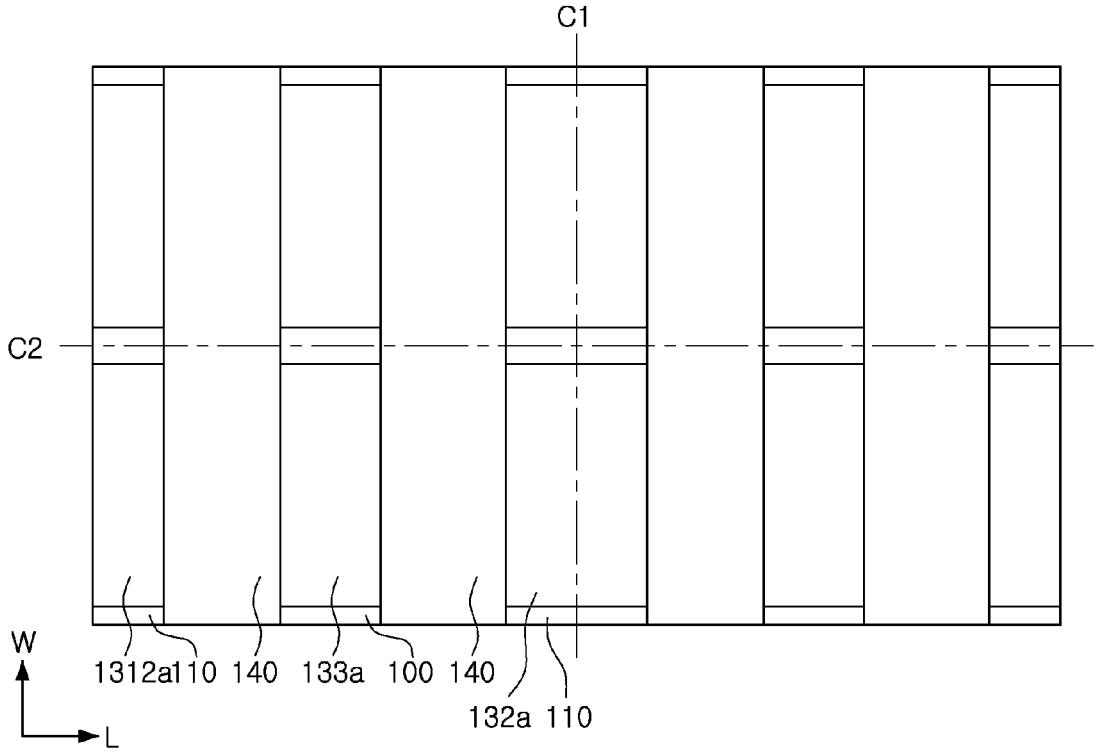

After controlling the resistance values, as illustrated in FIG. 7D, a protective layer 140 may be formed on a surface of the resistor layer exposed since the first to third electrode layers are not disposed.

Figure 7E:
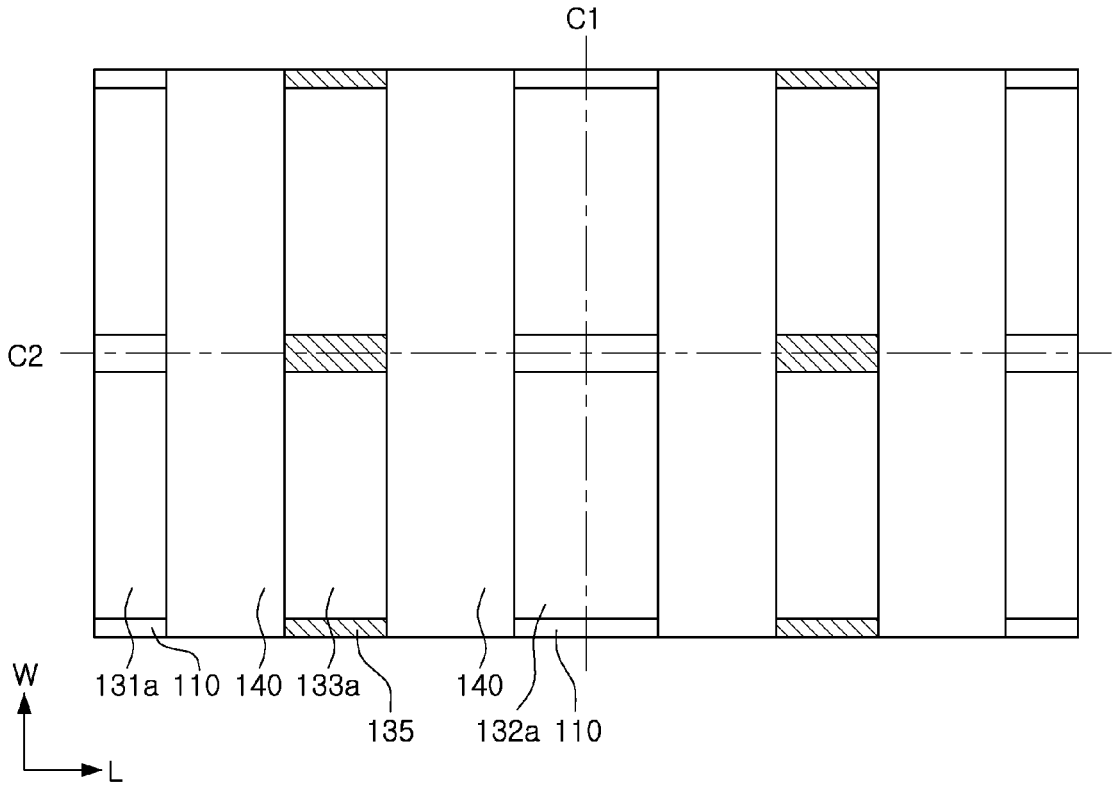

As illustrated in FIG. 7E, conductive resin electrodes 135 may be formed on both ends of the third electrode layer 133*a* S5. The conductive resin electrodes 135 may cover margins of the base substrate exposed to both ends of the third electrode layer in a width direction, and may be formed by applying a conductive paste including conductive particles and a base resin and then curing the conductive paste.

The conductive particles may include metal particles having high conductivity. The base resins may include thermosetting resin, and the thermosetting resin may include an epoxy resin, but the material of the base resin is not limited thereto.

Figure 7F:
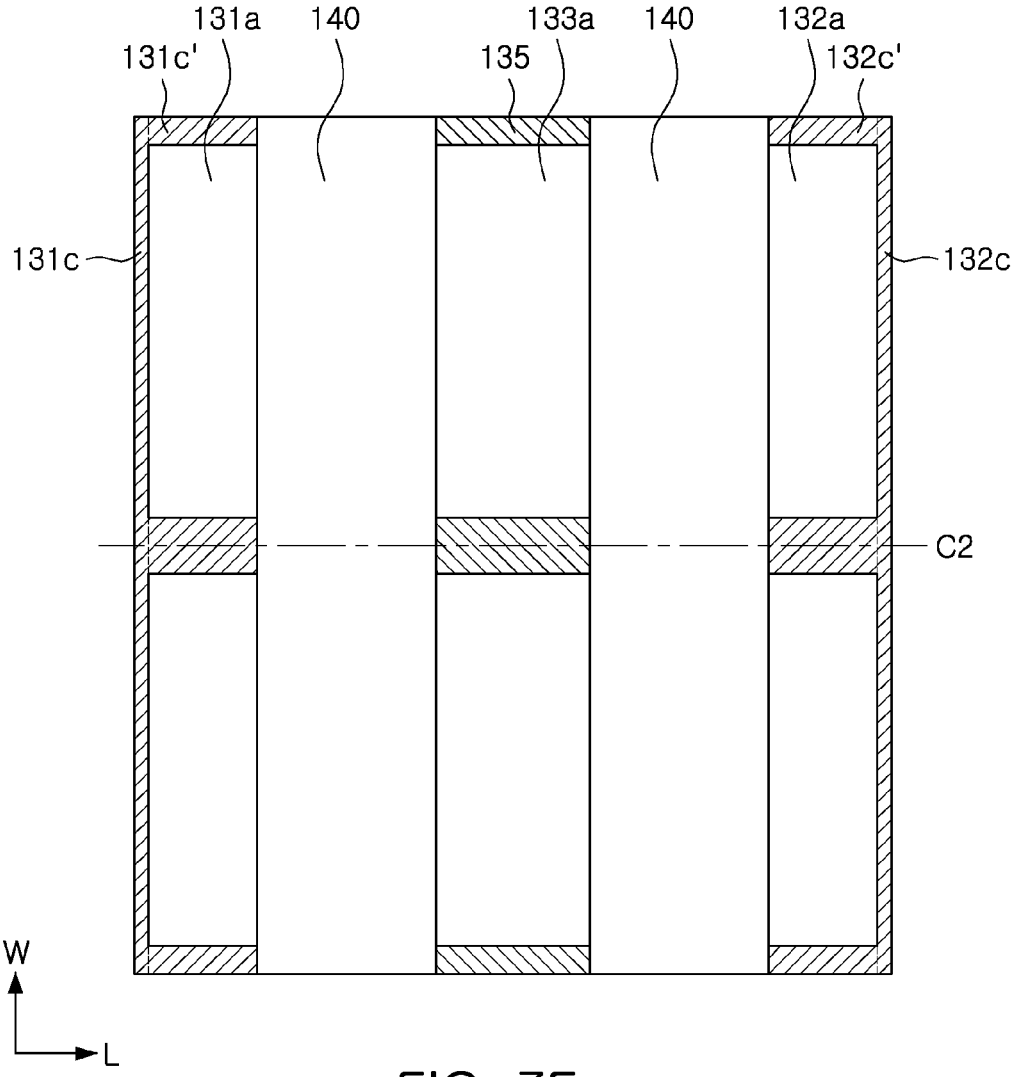

Next, the base substrate having the resistor layer, the first to third electrode layers, the protective layer, and the conductive resin electrodes thereon may be cut along the cutting line C1, and as illustrated in FIG. 7F, side surface electrodes may be formed.

The side surface electrodes may be formed using a sputtering process, and in the formation of the side surface electrodes, extension parts of the first and second electrode layers may be formed of the same materials as materials forming the side surface electrodes by reinforcing both ends of the first and second electrode layers and margin parts of the adjacent base substrate in a width direction.

Figure 7G:
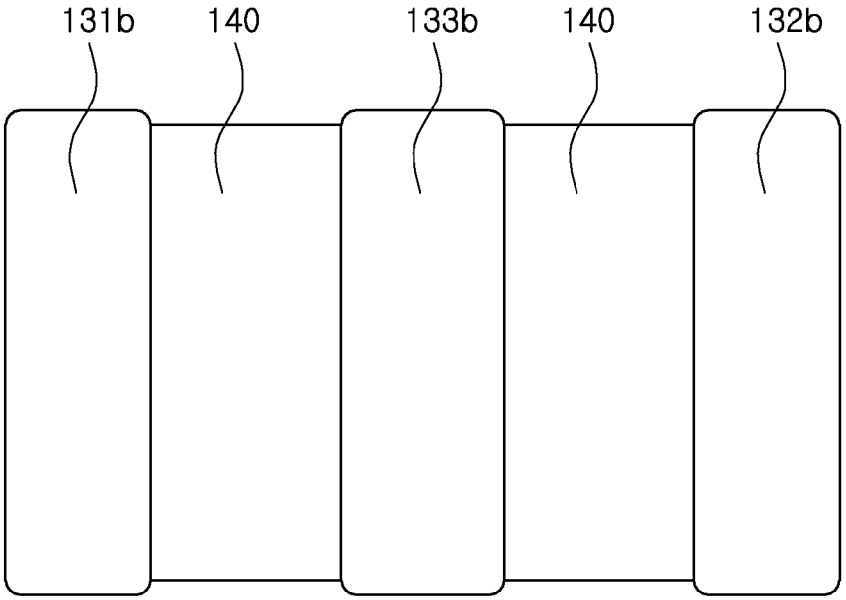

Next, the base substrate having the resistor layer, the first to third electrode layers, the protective layer, the conductive resin electrodes, and the side surface electrodes thereon may be cut along with the cutting line C2, and as illustrated in FIG. 7G, the first to third plating layers 131*b*, 132*b*, and 133*b* may be formed on the first to third electrode layers, respectively.

Figure 8:
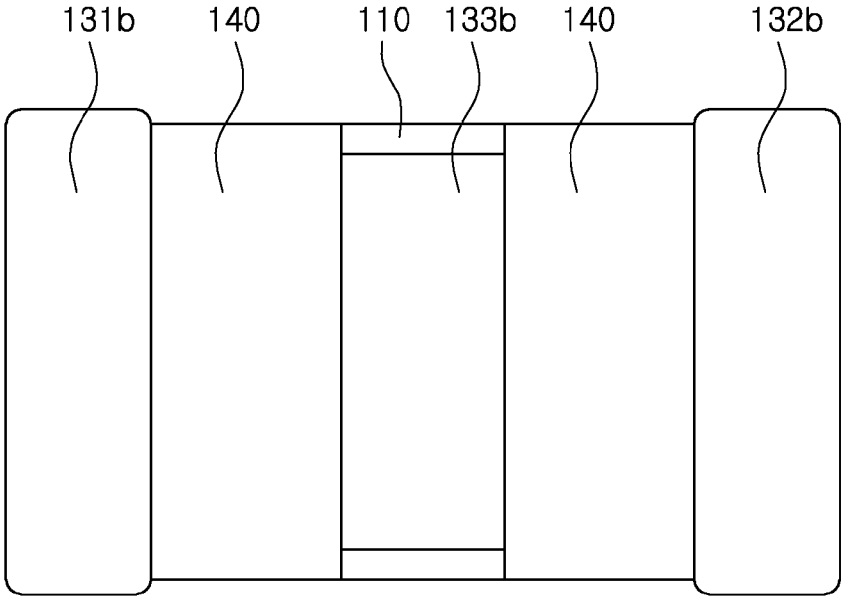
FIG. 8 is a plan view illustrating a resistor element according to a comparative example.

FIG. 8 is a plan view illustrating a resistor element according to a comparative example in which the conductive resin electrode is not disposed on the surface of the third electrode layer. In a case in which the third terminal is short since the third terminal has not been reinforced with the conductive resin electrode as illustrated in FIG. 8, mounting defects may occur due to an exposed base substrate.

However, according to the exemplary embodiment in the present disclosure, non-uniform lengths between the third terminal and the first and second terminals may be overcome to improve mounting stability, and a length of the third terminal may be increased to improve heat radiation property and warpage strength property of the resistor element.

Board Having Resistor Element Mounted Thereon

Figure 9:
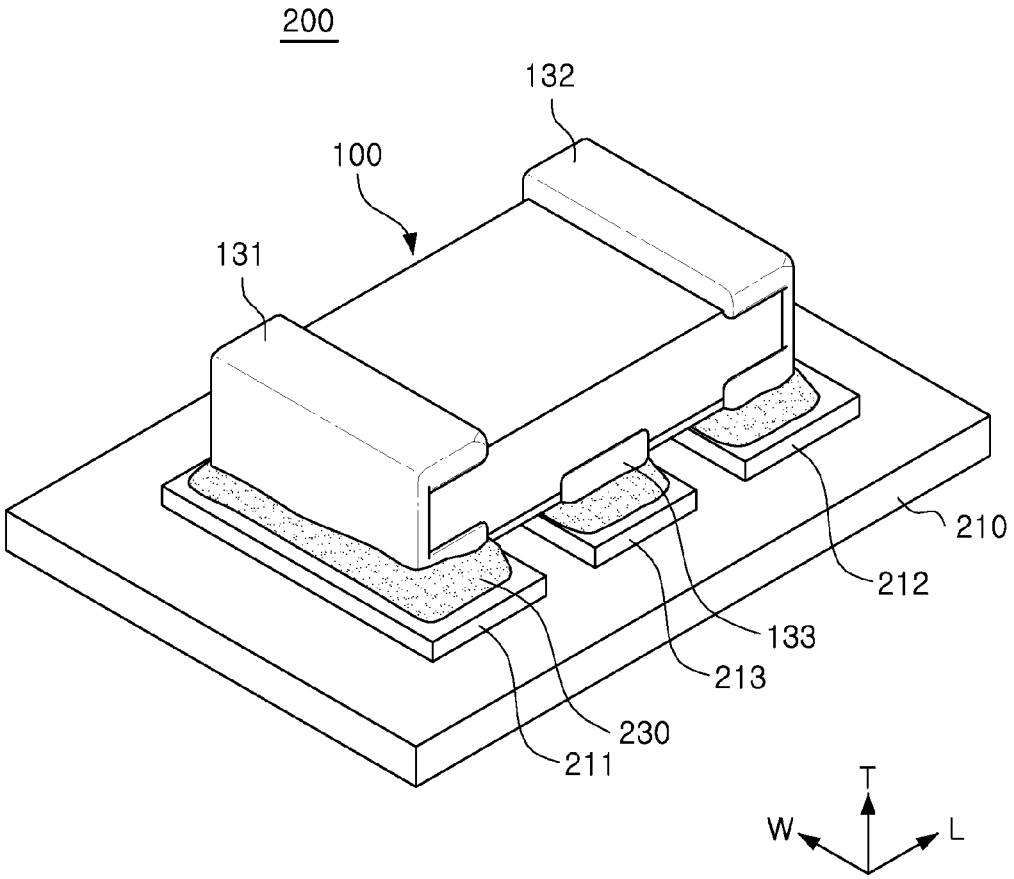
FIG. 9 is a perspective view of a board having the resistor element mounted thereon according to another exemplary embodiment in the present disclosure.

FIG. 9 is a perspective view of a board having a resistor element mounted thereon according to another exemplary embodiment in the present disclosure.

Referring to FIG. 9, the board having the resistor element mounted thereon 200 according to the present exemplary embodiment in the present disclosure may include a resistor element 100 and a circuit board 210 on which the first to third electrode pads spaced apart from each other are disposed.

The resistor element 100 may include a base substrate, a resistor layer disposed on one surface of the base substrate, a first electrode layer and a second electrode layer disposed on the resistor layer to be spaced apart from each other, a third electrode layer disposed between the first electrode layer and the second electrode layer to be spaced apart from the first electrode layer and the second electrode layer, conductive resin electrodes disposed on both ends of the third electrode layer, and first to third plating layers disposed on the first to third electrode layers, respectively.

The resistor element 100 according to the present exemplary embodiment in the present disclosure is described above.

The circuit board 210 has electronic circuits formed thereon. That is, integrated circuits (IC) for specific operations or a control of electronic devices, or the like, may be formed on the circuit board, such that currents supplied from separate power may flow in the circuits.

In this case, the circuit board 210 may include various wiring lines or further include different kinds of semiconductor devices such as a transistor, and the like. In addition, the circuit board 210 may include a conductive layer, a dielectric layer, and the like, to be variously configured if needed.

The first to third electrode pads 211, 212, and 213 may be spaced apart from each other on the circuit board 210, and may be connected to the first to third terminals of the resistor element, respectively, by solder 230.

Through the first to third electrode pads, the first to third terminals may be electrically connected to the electrical circuits, such that the first resistor part and the second resistor part formed between the first to third terminals may be connected to the circuit.

As set forth above, according to exemplary embodiments in the present disclosure, there are provided a resistor element having an excellent space efficiency and reduced defective rate at the time of mounting the resistor element on a substrate, a method of manufacturing the same, and a board having the same.

While exemplary embodiments have been shown and described above, it will be apparent to those skilled in the art that modifications and variations could be made without departing from the scope of the present disclosure as defined by the appended claims.

What is claimed is:

1. A resistor element comprising:

a base substrate;

a resistor layer disposed on one surface of the base substrate;

a first electrode layer and a second electrode layer disposed on the resistor layer to be spaced apart from each other;

a third electrode layer immovably disposed in electrical contact with the resistor layer in a space separating the first electrode layer and the second electrode layer and spaced apart from the first electrode layer and the second electrode layer;

a conductive resin electrode disposed on at least one end of the third electrode layer; and first to third plating layers covering the first to third electrode layers, respectively.

2. The resistor element of claim 1, wherein the third plating layer covers the third electrode layer and the conductive resin electrode.

3. The resistor element of claim 1, wherein the conductive resin electrode includes conductive particles and a base resin.

4. The resistor element of claim 3, wherein the base resin is as a curable resin.

5. A resistor element comprising:

a base substrate;

a resistor layer disposed on one surface of the base substrate;

a first electrode layer and a second electrode layer disposed on the resistor layer to be spaced apart from each other;

a third electrode layer disposed in a space separating the first electrode layer and the second electrode layer and spaced apart from the first electrode layer and the second electrode layer;

a conductive resin electrode disposed on at least one end of the third electrode layer; and first to third plating layers covering the first to third electrode layers, respectively, wherein the resistor layer includes a first resistor part connected to the first electrode and the third electrode to form resistance, and a second resistor part connected to the second electrode and the third electrode to form resistance, and the first resistor part is integrally formed with the second resistor part.

6. The resistor element of claim 1, wherein the resistor layer includes a first resistor part connected to the first electrode and the third electrode to form resistance, and a second resistor part connected to the second electrode and the third electrode to form resistance, and any one of the first resistor part and the second resistor part is trimmed according to a resistance value thereof to determine a resistance value of the remaining resistor part.

7. The resistor element of claim 1, further comprising a protective layer disposed on portions of a surface of the resistor layer exposed between the first to third electrode layers.

8. A method of manufacturing a resistor element comprising:

preparing a base substrate;

forming a resistor layer on one surface of the base substrate;

forming first to third electrode layers at fixed locations on and in electrical contact with the resistor layer;

controlling a resistance value by measuring resistance between two or more electrode layers among the first to third electrode layers;

forming a conductive resin electrode on at least one end of the third electrode layer by applying a conductive paste thereto; and forming first to third plating layers covering the first to third electrode layers, respectively.

9. The method of claim 8, wherein the third plating layer covers the third electrode layer and the conductive resin electrode.

10. The method of claim 8, wherein the conductive paste includes conductive particles and a base resin.

11. The method of claim 10, wherein the base resin includes a curable resin, and the conductive resin electrode is formed by curing the curable resin.

12. The resistor element of claim 1, wherein the first and second electrode layers are spaced apart from each other in a length direction, the third electrode layer is spaced apart from an edge of the base substrate in a width direction orthogonal to the length direction, and the conductive resin electrode is disposed on the one surface of the base substrate between the third electrode layer and the edge of the base substrate in the width direction.

13. The method of claim 8, wherein the first, second, and third electrode layers are formed at locations spaced apart from each other in a length direction on the resistor layer, the third electrode layer is formed to have the at least one end thereof be spaced apart from an edge of the base substrate in a width direction orthogonal to the length direction, and the conductive resin electrode is formed on the one surface of the base substrate between the at least one end of the third electrode layer and the edge of the base substrate in the width direction.

* * * * *